US007201277B2

(12) United States Patent
Wilke

(10) Patent No.: US 7,201,277 B2
(45) Date of Patent: Apr. 10, 2007

(54) DEVICE FOR AUTOMATICALLY MERGING MANUALLY PROCESSABLE MAIL FLATS WITH A FLOW ACCORDING TO THE DISTRIBUTION SEQUENCE OF SORTED MAIL ITEMS

(75) Inventor: Wolf-Stephan Wilke, Constance (DE)

(73) Assignee: Siemens AG, München (DE)

( * ) Notice: Subject to any disclaimer, the term of this patent is extended or adjusted under 35 U.S.C. 154(b) by 0 days.

(21) Appl. No.: 10/924,962

(22) Filed: Aug. 25, 2004

(65) Prior Publication Data

US 2005/0056572 A1 Mar. 17, 2005

Related U.S. Application Data

(60) Provisional application No. 60/499,613, filed on Sep. 3, 2003.

(30) Foreign Application Priority Data

Sep. 16, 2003 (DE) ..... 103 42 804

(51) Int. Cl.
*B03B 7/00* (2006.01)

(52) U.S. Cl. ..... 209/44.4; 209/700; 209/630; 209/44.4

(58) Field of Classification Search ..... 209/44.4, 209/702, 703, 704, 705
See application file for complete search history.

(56) References Cited

U.S. PATENT DOCUMENTS 5,994,657 A * 11/1999 Maier et al. ..... 209/584
2002/0113365 A1* 8/2002 Britton et al. ..... 271/303
2004/0016684 A1* 1/2004 Braginsky et al. ..... 209/702

FOREIGN PATENT DOCUMENTS

DE 199 43 362 A1 11/1999

(Continued)

OTHER PUBLICATIONS

Derwent Abstract—DE-199 43 362 A1; Mar. 22, 2001; Sorting apparatus for flat packages has trays arranged along conveyor path so that mail items are deposited in trays according to order of delivery addresses; Siemens AG, D-80333 München (Germany).

(Continued)

*Primary Examiner*—Gene O. Crawford
*Assistant Examiner*—Terrell Matthews
(74) *Attorney, Agent, or Firm*—Siemens AG

(57) ABSTRACT

Movable containers are provided over one part of the section conveyor on which the mail items are filed according to the distribution sequence, said moveable containers circulating in an enclosed transport path and each having several compartments controlled to open downwards for each respective mail item. The compartments can only be emptied if the containers are in the neutral position at a sorting station. Automatic emptying takes place on the sections assigned to the delivery points according to the known destination address of the mail items. After a container has been emptied, it can be driven to a loading station at which the compartments are filled with mail items, the compartments with the mail items being assigned to the delivery points according to the respective destination address and this assignment is transmitted to a device for the controlled opening of the compartments.

10 Claims, 2 Drawing Sheets

FOREIGN PATENT DOCUMENTS

| | | |
|---|---|---|
| DE | 198 29 484 C1 | 3/2001 |
| WO | WO 2004/007 102 A1 | 1/2004 |

OTHER PUBLICATIONS

Derwent Abstract—DE-198 29 484 C1; Nov. 11, 1999; Sorting system combining three stacks of paper into one has three sets of conveyor belts with code readers discharging onto main conveyor leading to output stack; Siemens AG, D-80333 München (Germany).

* cited by examiner

DEVICE FOR AUTOMATICALLY MERGING MANUALLY PROCESSABLE MAIL FLATS WITH A FLOW ACCORDING TO THE DISTRIBUTION SEQUENCE OF SORTED MAIL ITEMS

CROSS REFERENCE TO RELATED APPLICATIONS

The present application claims priority to provisional patent application 60/499,613, filed on Sep. 3, 2003, and German patent application 10342804.6, filed Sep. 16, 2003, which is herein incorporated by reference.

BACKGROUND OF THE INVENTION

In the finest sorting of mail items, said mail items are sorted according to delivery points in the distribution sequence. With all the hitherto known automation solutions however some of the mail items can still only be processed manually. They can therefore not be inserted by machine into the stacks of mail items. This is then done by the mail operative. This is essentially because of the format characteristics. If these mail items are not inserted into the bundle for each delivery point or at least at the correct point in the stack, the time saving that can be achieved during delivery is reduced, as in addition to the bundle stack, the mail operative also has to process a second stack of manual mail items.

As the automation solutions are to be found, inter alia, at a sorting centre, as a rule the mail operative cannot automatically add these manual mail items to a machine-generated mail item flow or batch. In so far as manually processable mail items had to be merged with a stack of mail items sorted by machine in distribution sequence, the stack or mail items sorted by machine into distribution sequence, the stack of mail items sorted by machine into distribution sequence was also frequently sorted again manually by the mail operative into the compartments into which manual mail items were also sorted. This process however requires a great deal of time and effort.

SUMMARY OF THE INVENTION

The object of the invention is therefore to create a device for the automatic merging of manually processable mail flats with a flow automatically according to the distribution sequence of sorted mail items, with which the necessary manual time and effort are reduced.

Movable containers are provided over one part of the driven section conveyor on which the mail items are automatically filed in the distribution sequence, said movable containers circulating in an enclosed transport path and each having several compartments controlled to open downwards for each respective mail item. The compartments can only be emptied if the containers are in the neutral position at stationary sorting stations and automatic emptying takes place on the sections assigned to the delivery points according to the known destination address of the mail items. After a container has been emptied, it can be moved to a loading station at which the compartments are filled with mail items, said compartments with the mail items being assigned to the delivery points of the distribution sequence according to the respective destination address, this assignment is transmitted to a device for the controlled opening of the compartments. In this way, the post operative is largely relieved of the task of manual sorting.

Thus, it is advantageous for an inexpensive embodiment if each compartment accommodating a mail item in an upright position has a floor which can be opened, the opening of which takes place in the sorting station of the container to eject the mail item by means of stationary control units which engage corresponding opening mechanisms of the compartments.

In order to ensure the defined sliding of the mail items into the sections of the moving section conveyor, it is advantageous if the compartments slope to the back in the transport direction of the section conveyor.

It is also advantageous to arrange stationary control units for closing the compartments in the transport direction of the containers to the sorting stations, whereby the technical expenditure for the opening and closing mechanism of the compartments can be reduced.

So that the loading procedure can be isolated from the unloading procedure of the containers, the transport path of the containers is designed in such a way that a fixed number of loaded containers can be kept in a storage position in front of the loading station and/or in front of the sorting station/s until the respective station becomes free.

It is also advantageous if the loading station is equipped for manual loading of the compartments and has a coding device for manual entry of the delivery addresses.

In order to reduce online coding expense, the loading station has a framework wall for manual pre-sorting of mail items before loading of the compartments. The common address details for each pre-sorted distribution section are specified by the machine control unit before the start of compartment loading in order to adhere to the processing sequence pertaining to the automatically sorted mail item flow. Therefore only the house numbers still need to be coded.

It is likewise advantageous to show the current distribution areas to be entered on displays at the loading point and on the compartments of the framework wall in order to avoid entry errors.

BRIEF DESCRIPTION OF THE SEVERAL VIEWS OF THE DRAWINGS

The invention is described below using an exemplary embodiment with reference to the drawing, in which.

DETAILED DESCRIPTION OF THE INVENTION

Figure 1:
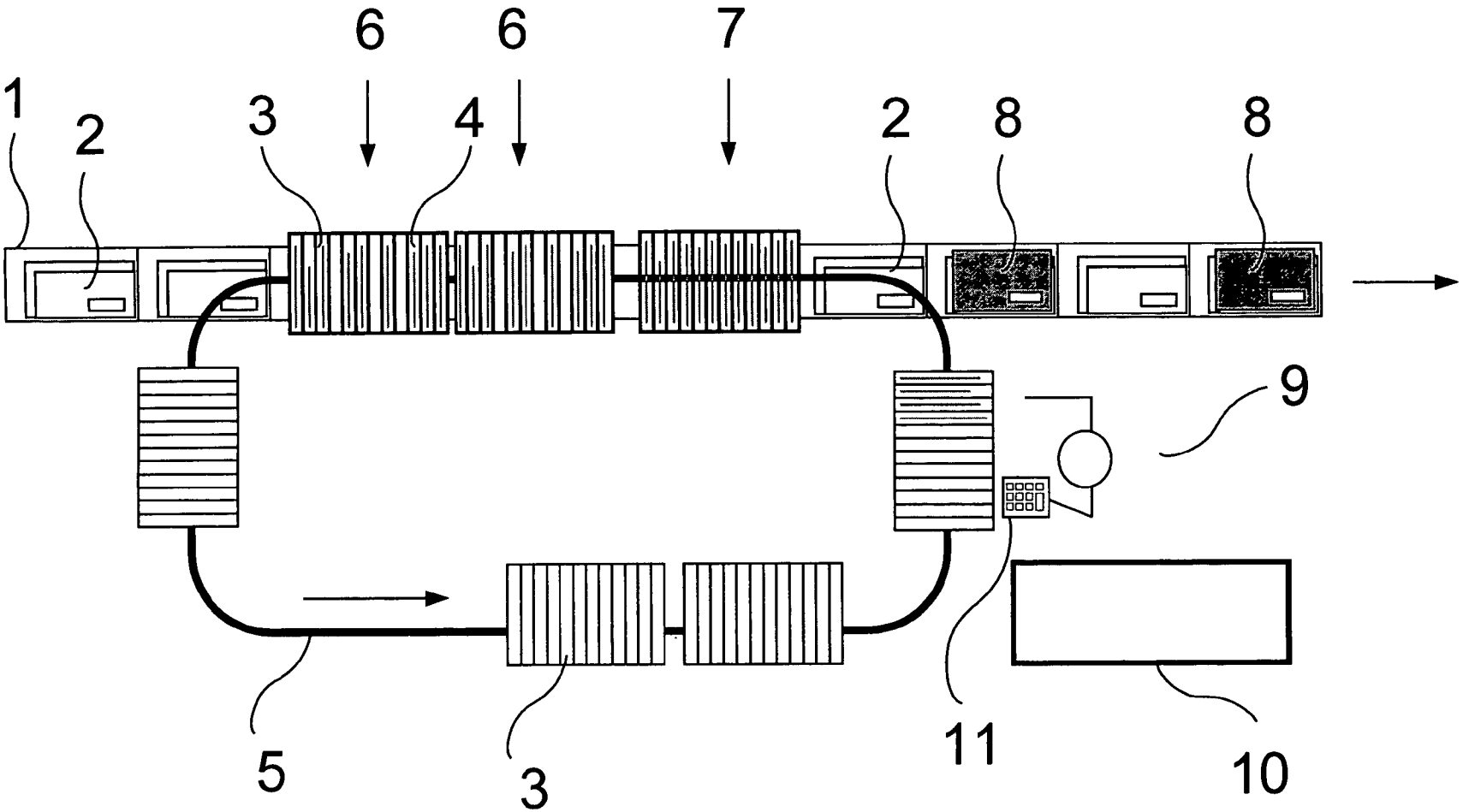
FIG. 1 shows a diagrammatic top view of a device according to the invention.

As shown in FIG. 1, a section conveyor 1 transports mail items 2 (in each section there are mail items pertaining to a delivery point) in the distribution sequence from left to right to a collecting station (not shown) at which the mail items are then collected in containers in the distribution sequence. In front of this collecting station there may be another packing station at which the mail items pertaining to a delivery point are packed or bundled.

The mail items 2 were put into the sections of the section conveyor 1 as a result of an automatic sorting process. Transport path 5 runs over part of the section conveyor 1 in the opposite direction to circulating containers 3 with several compartments 4 for one small mail item each in the upright position. There are several containers 3 in one run which move asynchronously. This can occur if each container 3 has its own drive which can be controlled independently of the drives of the other containers 3 or an endless conveyor circulates constantly to which the containers can be coupled and uncoupled, e.g. at particular wait positions or by means of a stationary container 3. At sorting stations 6 above the section conveyor 1, the containers 3 filled with mail items 8 which cannot be automatically processed during sorting are stopped and then emptied onto the corresponding sections according to the known assignment of the sections of the section conveyor 1 to the delivery points and their known delivery address. This is explained in greater detail below.

If the respective container 3 has been completely emptied at its sorting station 6 and is not prevented from continuing by a container 3 in front of it, it is supplied to a loading station 9 via the circulating transport path 5 by being stopped in the loading position and loaded manually. During loading, the respective mail item 8 is also coded by the operator, i.e. he enters the data of the read delivery address (destination address) into a coding device (keyboard) 11. From this data the delivery point is then automatically ascertained with the aid of a file in which the delivery points and optionally their order in the distribution sequence are assigned to the destination addresses. The delivery point is then assigned to the respective compartment 4, transmitted to the device for the controlled opening of the compartments 4 which controls the unloading of the compartments 4 in the sorting position 6 on the sections of the section conveyor 1. This device also has the details of which conveyor belt section is assigned to which delivery point so that the corresponding compartment 4 is then opened if the conveyor belt section moving past is the one assigned to it. In order to keep the coding expenditure for each mail item 8 as low as possible, the mail items 8 are presorted into distribution areas (e.g. street) in a framework wall 10. If the mail items 8 of a particular distribution area are loaded into the compartments of the container, this distribution area is shown by means of a display which is controlled by the machine control unit and when loading only the house number need still be coded. Both in front of the loading station 9 as well as in front of the sorting position/s 6, the containers 3 can remain in storage positions until their acceptance at the following station 9, 6 is possible.

According to FIG. 1, the device on the section conveyor 1 is in the transport direction of the sorter which automatically assigns the section conveyor 1. As a result, the mail items 8 which can only be processed manually are uppermost in the respective section. Naturally, it is also possible to arrange the device in front of the sorter so that the manually processed mail items 8 are at the bottom.

Figure 2:
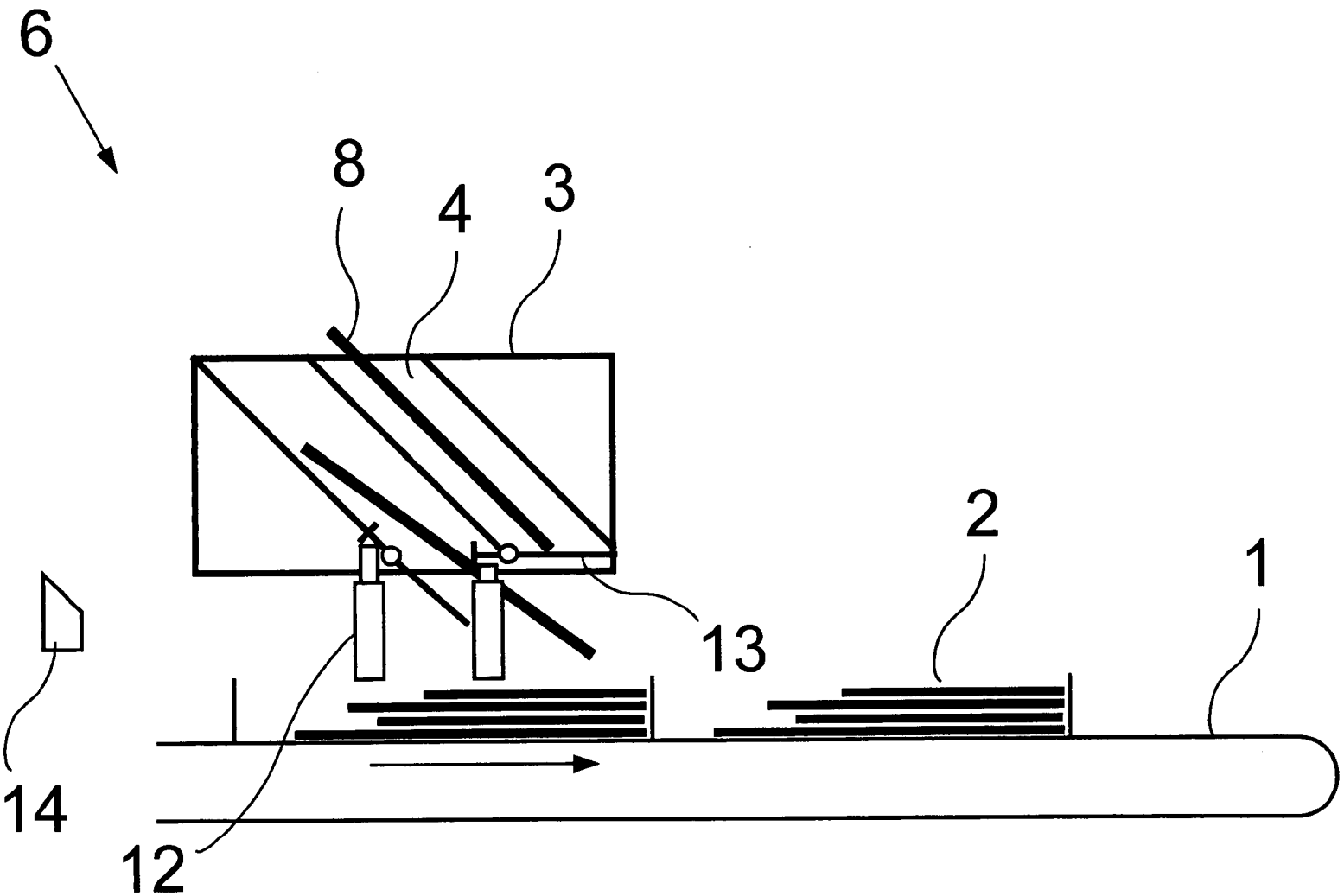
FIG. 2 shows a diagrammatic side view of a container at a sorting station.

In FIG. 2 the emptying of container 3 at the sorting station 6 is explained in more detail. Container 3 has several, small, diagonally arranged compartments 4—sloping to the back in the transport direction of the section conveyor 1—in which the mail items 8 are positioned on their narrow sides. Each compartment 4 has a floor 13 which can be swiveled downwards, to which a lever directed to the outside is attached. If the container 3 has arrived at the sorting position, it is stopped and underneath each lever extending sideways from the container 3, a stationary opening mechanism 12 (e.g. a solenoid) is located. Beneath the container 3, the section conveyor 1 loaded in the sorter moves to the right in the direction of the arrow. If a section runs just under a hopper 4—which has the same delivery point assignment as the mail item 8 in this hopper, then the moving part of the opening mechanism 12 presses from below against the lever and causes the floor 13 to swivel down so that the mail item 8 falls onto this section. In order for this to take place in a defined manner with a good batching image, the compartments 4 are inclined in such a way that the mail items 8 slide into the section. As soon as the container 3 is completely empty, it is transported further in the opposite direction to the section conveyor 1, which is also possible in the transport direction, and runs past a stationary closing device 14 which results in all levers being pressed into the original position, i.e. in the floor 13 swiveling upwards and all compartments 4 being closed again as a consequence.

I claim:

1. A device for automatically merging manually processable mail flats with a flow, in a sorter, according to a distribution sequence of sorted mail items, filed on a section conveyor which transports the mail items in sections to a collecting station at which the mail items are coordinated according to the distribution sequence, the device comprising:

containers movable independently from each other along an enclosed transport path, provided over one part of the section conveyor, the containers circulating independently from each other along the enclosed transport path and each comprising several coupled compartments controlled to open downwards for one mail item each such that the compartments may only be emptied if the containers are in a neutral position at stationary sorting stations and automatic emptying takes place on sections assigned to delivery paints in accordance with known destination addresses, and driving means for driving the container, after it has been emptied, to a loading station at which the compartments are filled with mail items, the compartments with the mail items being assigned to delivery points of distribution sequences according to respective destination addresses, and transmitting means for transmitting assignment information relating to the assigned delivery points to a device for controlled opening of the compartments.

2. The device according to claim 1, wherein each compartment comprises a floor and an opening mechanism for opening the floor, and the sorting station comprises stationary control units arranged to open the floor by engaging the opening mechanisms.

3. The device according to claim 2, wherein the compartments slope to the back in a transport direction of the section conveyor.

4. The device according to claim 1, wherein the stationary control units further comprise means for closing the compartments which are arranged in a transport direction of the containers to the sorting stations.

5. The device according to claim 1, wherein the transport path of the containers is such that a fixed number of loaded containers can be kept in a storage position in front of the loading station and in front of the sorting station until one of the loading and sorting stations becomes free.

6. The device according to claim 1, wherein the loading station further comprises means for manual loading of the compartments and a coding device for manual entry of delivery addresses.

7. The device according to claim 6, wherein the loading station further comprises a framework wail for manual pre-sorting of mail items before loading of compartments and address details for each pre-sorted distribution area before a start of compartment loading.

8. The device according to claim 6, further comprising displays provided at the loading site and on the compartments of the framework wail, the displays showing a distribution section currently to be loaded.

9. The device according to claim 7, further comprising displays provided at the loading site and on the compartments of the framework wail showing a distribution section currently to be loaded.

10. The device according to claim 1, wherein the transport path of the containers is such that a fixed number of loaded containers can be kept in a storage position in front of the loading station or in front of the sorting station until one of the loading and sorting stations becomes free.

* * * * *